US005101775A

United States Patent [19]

Hubbs

[11] Patent Number: 5,101,775

[45] Date of Patent: Apr. 7, 1992

[54] COOLING APPARATUS FOR ENGINE RADIATOR

[76] Inventor: Perry E. Hubbs, 24688 Fay Ave., Moreno Valley, Calif. 92552

[21] Appl. No.: 639,287

[22] Filed: Jan. 10, 1991

[51] Int. Cl.[5] ..... F01P 9/00

[52] U.S. Cl. ..... 123/41.01; 123/41.55

[58] Field of Search ..... 123/41.01, 41.44, 41.55, 123/41.3; 165/137

[56] References Cited

U.S. PATENT DOCUMENTS 2,481,135 9/1949 Maness et al. ..... 123/41.55
3,123,056 3/1964 Kneblik ..... 123/41.01
3,769,947 11/1973 Crain ..... 123/41.01

FOREIGN PATENT DOCUMENTS 764277 12/1956 United Kingdom ..... 123/41.01

*Primary Examiner*—Noah P. Kamen
*Attorney, Agent, or Firm*—Harvey C. Nienow

[57] ABSTRACT

Cooling apparatus for the cooling system of an internal combustion engine or the like, including water-spraying apparatus which includes one or more spraying elements attached to the radiator of such engine, a source of fluid and pump means for pumping fluid from the source of fluid to such spraying elements.

5 Claims, 1 Drawing Sheet

COOLING APPARATUS FOR ENGINE RADIATOR

The present invention relates generally to cooling means for internal combustion engines and the like, but more particularly to cooling means for periodically providing a cooling function for preventing the overheating of an internal combustion engine.

BACKGROUND OF THE INVENTION

Internal combustion engines and the like generate a considerable amount of heat due to the burning of fuel therewithin, and the resulting heat may accumulate to a dangerous level because it does not dissipate quickly enough. Such excessive heat can easily harm the parts or components of the engine, such as causing them to warp or change position, thus making the engine less useable.

Cooling systems, of course, are provided for such engines and usually comprise a water-circulation system which includes a radiator through which ambient air flows so as to cause the cooling fluid to be cooled for recirculation back through the inner portions of the engine. Such cooling systems are closed so that the same cooling medium or fluid circulates throughout the engine as it is operated.

However, conditions can result wherein due to faulty circulation of such cooling medium, the temperature of the engine reaches or tends to reach the point where deleterious results to the engine parts are obtained. Frequently, this results when insufficient air is drawn through the radiator to absorb or pick up the elevated temperatures of the medium which is circulating through the engine.

In view of the foregoing it is deemed beneficial to have an external cooling system for insuring the cooling of the fins of the engine radiator, as desired, so that under unusual conditions, adequate or even excessive cooling can be provided.

OBJECTS OF THE INVENTION

It is an object of the present invention to provide cooling apparatus for the radiator of internal combustion engines whereby the human operator of the engine can, at will, cause additional cooling to the radiator fluid.

Another object of the present invention is to provide cooling apparatus for internal combustion engines as characterized above wherein a cooling fluid is sprayed onto the cooling fins of the usual internal combustion engine radiator, as desired.

A still further object of the present invention is to provide cooling apparatus for the engine of automobiles whereby the driver can, as necessary, simply by actuating a switch, apply a fluid cooling medium to the fins of the engine radiator.

Another still further object of the present invention is to provide cooling apparatus as characterized above which comprises a reservoir of fluid connected to spraying apparatus fastened to the engine radiator, there being switch-operated pump means for enabling the operator to spray the cooling fluid on the radiator.

An even further object of the present invention is to provide cooling apparatus as characterized above which is simple and inexpensive to manufacture and which is rugged and dependable in operation.

BRIEF DESCRIPTION OF THE DRAWINGS

The novel features which I consider characteristic of my invention are set forth with particularity in the appended claims. The invention itself, however, both as to its organization and mode of operation, together with additional objects and advantages thereof, will best be understood from the following description of specific embodiments when read in combination with the accompanying drawings, in which:

Like reference characters indicate corresponding parts throughout the several views of the drawings.

DESCRIPTION OF THE PREFERRED EMBODIMENT

Figure 1:
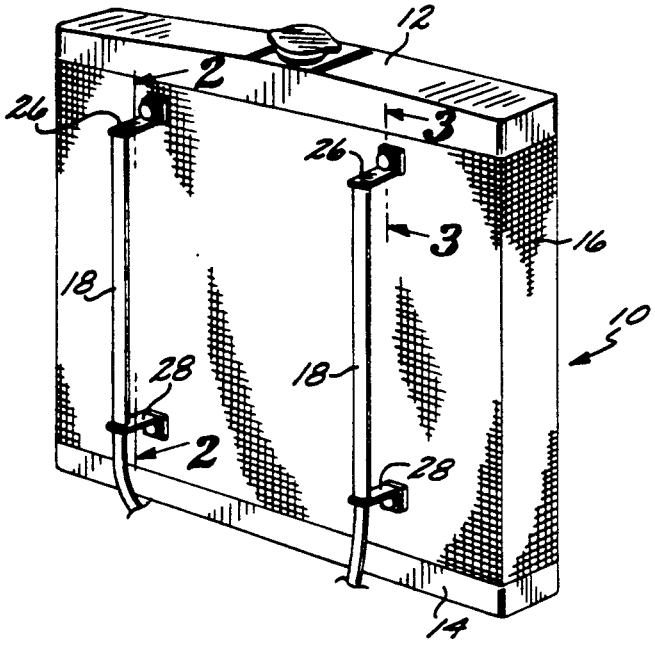
FIG. 1 is a perspective view of an engine radiator showing the attachment thereto of spraying elements.

Referring to FIG. 1 of the drawings, there is shown therein a radiator 10 which is associated with an internal combustion engine (not shown), as found in most automobiles today. Typically, such radiator 10 is formed with upper and lower manifolds 12 and 14 respectively interconnected by means of a plurality of cooling fins 16 which are represented diagramatically in FIGS. 1 and 3 of the drawings.

As is well understood by those persons skilled in the art, such fins comprise a multiplicity of small channels or tubes wherein the cooling fluid of the automobile cooling system is exposed to the ambient air through heat-conductive walls of such channels or tubes. Typically, such radiator 10, as associated with automobile internal combustion engines, is positioned at the forward end of the automobile so as to receive the onrushing air which results from the forward motion of the automobile. In addition thereto, auxiliary fans may be provided for drawing or pushing the ambient air over the radiator cooling fins under certain prescribed engine conditions.

It is realized within the scope of the present invention that the subject cooling apparatus can be beneficial for substantially any type of cooling system for virtually any type of engine wherein the usual cooling system is found to be inadequate under certain conditions. That is, although the subject cooling apparatus is particularly well adapted for use in association with radiators which are part of internal combustion engines for automobiles, it is believed that other types of engines for use in different environments can benefit from the subject invention.

Figure 2:
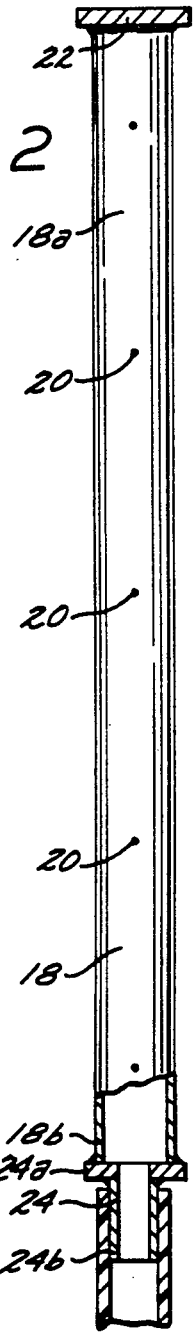
FIG. 2 is a fragmentary sectional view taken substantially along line 2—2 of FIG. 1 of the drawings.

Attached to the radiator 10, in accordance with the present invention, are two cooling or spraying elements 18 each of which may be formed with a tubular body made from metal, plastic or the like, consistent with the temperatures to be encountered, as will hereinafter become apparent. Each tubular element 18, as shown most particularly in FIG. 2 of the drawings, is formed with one or more outlet openings 20 formed in the sidewall of such tubular element. The latter may be circular in cross-section or square in cross-section, as desired, and can be of substantially any size diameter sufficient to receive fluid, as will hereinafter appear. The upper end 18*a* of each element 18 is closed by means of a cap 22 which may be welded or otherwise bonded to the end portion 18*a*. The lower end 18*b* of such element is provided with a fitting 24 which comprises an elongated plate-like member 24*a* formed with a through opening, and a tubular extension 24*b*.

Figure 3:
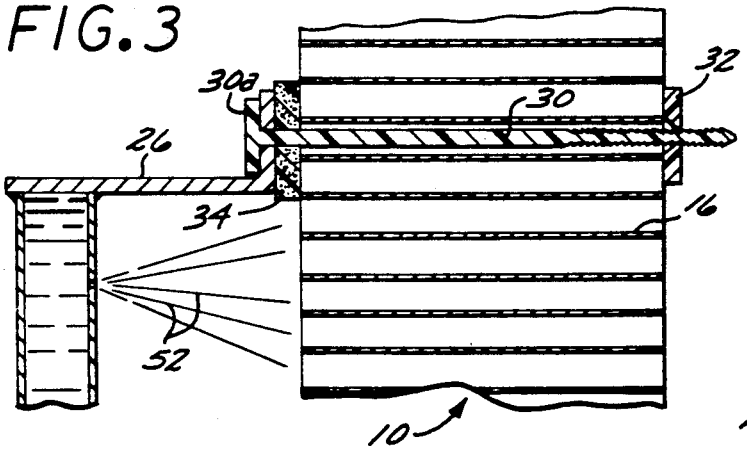
FIG. 3 is a fragmentary sectional view taken substantially along line 3—3 of FIG. 1 of the drawings.

As shown in FIGS. 1 and 3 of the drawings, the members 22 and 24 are L-shaped to constitute brackets 26 and 28 whereby the respective tubular element 28 can be firmly secured to the radiator 10 by means of a metal or plastic bolt 30 having a head 30*a*, and a plastic or metal fastening nut 32. Suitable resilient cushioning means, as shown at 34 in FIG. 3 of the drawings may be used to shock-mount the elements 18.

The outlet openings 20 in each tubular element 18 are so oriented with respect to the L-shaped brackets 26 and 28 that after mounting of the tubular elements 18 relative to the radiator 10, the openings 20 face directly toward the radiator, as shown most particularly in FIG. 3.

Figure 4:
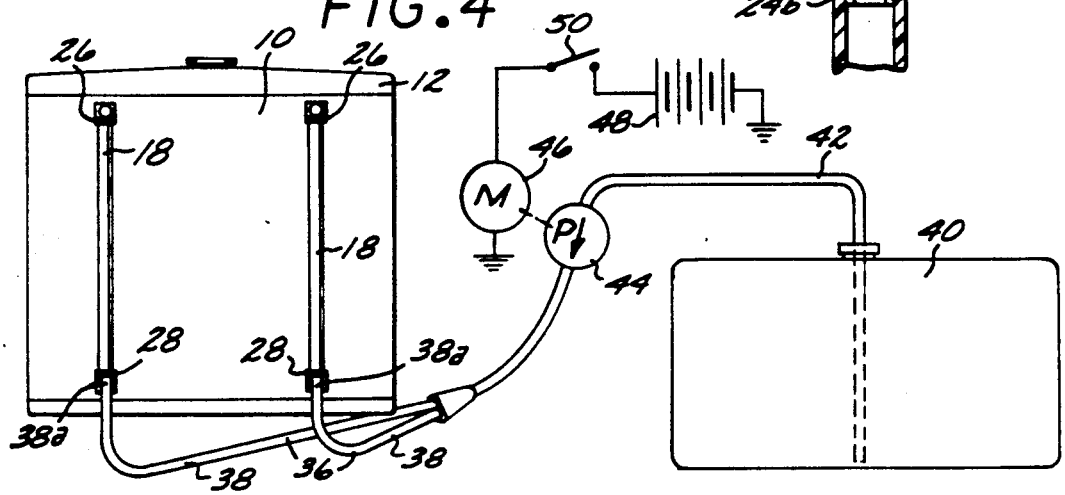
FIG. 4 is a diagrammatic .showing of the cooling apparatus according to the present invention.

Referring to FIG. 4 of the drawings, the elements 18 are connected to conduit means 36 which comprise flexible hoses or tubes 38, the end portions 38*a* of which sealingly fit over the tubular extension 24*b* of the fitting 24 for the respective element 18.

A reservoir 40 of cooling fluid is provided in association with a tubing 42, a pump 44 being operatively associated therewith. Tubing 42 is associated with the flexible hoses 38, the pump 44 being operated by a motor 46 which is energized by an electrical power source or battery 48 through an operating switch 50.

It is contemplated that for an application of the subject cooling apparatus to an automobile engine, the reservoir 40 might be positioned in the engine compartment of the automobile or within the trunk or luggage compartment of the automobile. The tube 42 and associated parts such as pump 44 and motor 46 may be positioned in any appropriate place, but the switch 50 should be within the passenger compartment, easily accessible to the driver of the automobile. The electrical power source 48 might well be the usual battery which is part of the automobile.

When the internal combustion engine tends to overheat, it is a simple matter for the driver of the automobile or operator of the engine to operate switch 50 to its closed position so as to energize motor 46 from the battery 48. This causes pump 44 to draw fluid from the reservoir 40 and to force or push the same into the elements 18. From there, the cooling medium or fluid is forced out through the holes 20 in the respective elements so as to provide a spray, as shown at 52 in FIG. 3 onto the cooling fins of the radiator 10. This causes further cooling of the radiator 10.

Although I have shown and described certain specific embodiments of my invention, I am well aware that many modifications thereof are possible. The invention, therefore, is not to be restricted except insofar as is necessitated by the prior art and by the spirit of the appended claims.

I claim:

1. Cooling apparatus for the radiator having cooling fins of an engine comprising, in combination, one or more tubular elements having one or more openings, fastening means comprising one or more brackets fixed to said tubular element and one or more elongated bolts extending between the cooling fins of an engine radiator to secure said brackets to said radiator, a source of fluid under pressure, and conduit means interconnecting said tubular element and said source of fluid whereby said fluid can be sprayed onto said radiator through said openings.

2. Cooling apparatus for the radiator of an engine according to claim 1 wherein one end of said tubular element is closed to prevent passage of said fluid therethrough and the other end is open and attached to one end of said conduit means.

3. Cooling apparatus for the radiator of an engine according to claim 2 wherein said conduit means comprises a flexible hose one end of which sealingly connects to a fitting secured to said other end of said element.

4. Cooling apparatus for the radiator of an engine according to claim 3 wherein said source of fluid also includes a reservoir of fluid and a fluid pump operatively connected between said reservoir and said conduit means.

5. Cooling apparatus for the radiator of an engine according to claim 4 wherein said source further includes switch means for controlling said pump and thereby the spraying of fluid on said radiator.

* * * * *